US006022507A

United States Patent [19]

Kempken et al.

[11] Patent Number: 6,022,507

[45] Date of Patent: Feb. 8, 2000

[54] EXCHANGE DEVICE FOR A BLOWING LANCE

[75] Inventors: Hans-Hermann Kempken, Hünxe; Manfred Kompa, Herten; Helmut W. Goj, deceased, late of Kamp-Lintfort, all of Germany, by Hildegard Isolde Goj, heiress

[73] Assignee: Thyssen Stahl AG, Duisburg, Germany

[21] Appl. No.: 09/066,443

[22] PCT Filed: Oct. 29, 1996

[86] PCT No.: PCT/EP96/04693

§ 371 Date: Sep. 11, 1998

§ 102(e) Date: Sep. 11, 1998

[87] PCT Pub. No.: WO97/17474

PCT Pub. Date: May 15, 1997

[30] Foreign Application Priority Data

Nov. 4, 1995 [DE] Germany ..... 195 41 199

[51] Int. Cl.[7] ..... C21C 5/46

[52] U.S. Cl. ..... 266/226; 266/225

[58] Field of Search ..... 266/225, 226, 266/265

[56] References Cited

U.S. PATENT DOCUMENTS

| | | | |
|---|---|---|---|
| 3,170,977 | 2/1965 | Obenchain . | |
| 4,893,791 | 1/1990 | Stomp et al. | 266/226 |
| 5,217,674 | 6/1993 | Stomp et al. | 266/226 |
| 5,275,384 | 1/1994 | Stomp et al. | 266/226 |

FOREIGN PATENT DOCUMENTS

| | | |
|---|---|---|
| 0 441 767 A3 | 8/1991 | European Pat. Off. . |
| 0 464 427 A3 | 6/1992 | European Pat. Off. . |
| 0 553 432 A1 | 8/1993 | European Pat. Off. . |
| 1 265 179 | 4/1968 | Germany . |
| 25 12 487 | 10/1975 | Germany . |
| 28 16 399 C2 | 11/1978 | Germany . |
| 38 28 928 A1 | 3/1989 | Germany . |

*Primary Examiner*—Scott Kastler
*Attorney, Agent, or Firm*—Proskauer Rose LLP

[57] ABSTRACT

A blowing lance and a coupling head are configured to permit facilitated exchange of the blowing lance as desired. The coupling head includes a receptacle in which an end portion of the blowing lance is receivable. The receptacle includes a tubular attachment which engages a portion of the blowing lance, creating a hermetically sealed connection therebetween for conduction of a blowing fluid, for example, oxygen. The coupling head further includes connections for coolant supply and discharge. The blowing lance includes a cooling jacket having an inlet and outlet, at least one of which emerges at a peripheral surface thereof. When the blowing lance is received in the receptacle of the coupling head, at least one chamber is formed therebetween, providing sealed communication between the coolant supply and/or coolant discharge connections of the coupling head and the inlet and/or the outlet of the cooling jacket of the blowing lance, respectively.

8 Claims, 2 Drawing Sheets

EXCHANGE DEVICE FOR A BLOWING LANCE

BACKGROUND OF THE INVENTION

The invention relates to a changing device for a blowing lance having a blowing tube and a cooling jacket through which coolant can flow and which encloses the blowing tube and whose inlet and outlet are disposed at the end of the blowing lance associated with a coupling head; the coupling head has a receptacle into which said end of the blowing lance can be introduced and which comprises connections for the coolant supply, the coolant discharge and the blowing fluid supply; and the blowing lance can be releasably coupled to the coupling head, while at least the inlet or the outlet of the cooling jacket emerge at a peripheral surface of the blowing lance, the connection associated with the inlet or outlet respectively being disposed on a lateral surface on the receptacle associated with the particular peripheral surface.

Blowing lances are used, for example, to inject oxygen into a converter during the production of steel. The problem of blowing lances inserted in this way is that after a certain period of use they become worn and must be interchanged.

To prevent premature damage to the blowing lance by the high surrounding temperatures in the zone of the converter, the blowing tube, through which the gas injected into the converter passes, is cooled by means of a coolant, usually water. For this purpose the blowing lances normally have a double jacket which encloses two interconnected chambers disposed coaxially with one another and with the blowing tube. The coolant is introduced into the first chamber, immediately adjoining the blowing tube, and then flows along the blowing tube as far as substantially its tip and from that point through the second chamber back to the outlet of the coolant jacket.

For the connection of the blowing fluid, coolant supply and coolant discharge lines, conventional blowing lances have flanges, to which these lines can be connected in conventional manner. When such a blowing lance has to be interchanged, this kind of connection between the supply and discharge lines causes the problem that a considerable time is required for their release and connection. Moreover, in such connections between the supply/discharge lines and the blowing lance, it is impossible to automate the interchange operation. Instead of this, there is the disadvantage that the operation of the blowing lance has to be interrupted for a prolonged period, to prevent danger to the assembling personnel occupied in interchanging the blowing lance.

The time required for the interchanging of the blowing lance can be reduced by means of a device which is disclosed in European Patent Application EP 0 464 427 A2. In that prior art interchangeable device the portion which is provided in the aforedescribed blowing lances for the connection of the supply and discharge lines is associated with a separate coupling head. The coupling head is attached to a frame which also comprises a hydraulic lifting system. The remaining portion of the blowing lance can be so latched into the lifting system that the appropriate end of the blowing lance can be introduced into the receptacle or coupling head. The end opening of the blowing tube and also the inlet and outlet of the cooling jacket are disposed on the end face of the blowing lance. Correspondingly, the connections for the coolant supply and discharge and also the blowing fluid supply are disposed at the end of the coupling head receptacle associated with the end face of the blowing lance.

When the prior art blowing lance is in use, the hydraulic lifting device continuously retains the end face of the blowing lance bearing against the end face of the receptacle, so as to ensure that the blowing tube, coolant inlet and coolant outlet are constantly sealed. At the same time, in view of the considerable pressure at which the coolant and the blowing fluid are introduced into the blowing lance, appreciable pressure forces are required to maintain a hermetic connection.

One device of the kind specified is known from European Patent Application EP 0 441 767 A2. In that device the connections for the coolant supply and discharge of the blowing lance are disposed, together with the connection for the blowing fluid, on a laterally attached plate. The coupling head of this prior art device, by means of which the blowing lance can be releasably coupled, also has a plate on which the connections for the blowing fluid and the coolant are correspondingly disposed. In this prior art device also a hydraulic device is used to press the connections of the coupling head heretically against the connections of the blowing lance.

It is true that the afore-explained prior art interchangeable devices enable a blowing lance to be interchanged within a short time, but they have the disadvantage of requiring expensive hydraulic lifting and pressure-applying devices, which are costly to obtain and maintain, in order to ensure that the blowing lance is permanently and securely hermetically pressed against the connections for the coolant supply and the blowing fluid.

Starting from the afore-explained prior art, it is an object of the invention to provide a changing device for the blowing lance which enables a blowing lance to be rapidly interchanged with low manufacturing and maintenance costs.

SUMMARY OF THE INVENTION

The aforementioned problem is solved in a changing device of the kind specified by the features

- when the blowing lance is introduced into the receptacle of the coupling head, the blowing tube is connected interengaging and hermetically to a tubular attachment of the receptacle which is connected to the blowing fluid supply; and
- when the blowing lance is inserted into the receptacle of the coupling head a chamber, more particularly an annular chamber, is formed in the zone of the connection for the coolant supply and/or the connection for the coolant discharge respectively.

The construction of the blowing lance and coupling head according to the invention enables the individual insertions and emergences of the blowing lance to be sealed simply by inserting the blowing lance into the receptacle. No expensive retaining device is required for after the blowing lance has been introduced into the receptacle, nor are electric, hydraulic or pneumatic devices required for the coupling operation. Instead of this, a simple coupling mechanism can be used, sealing means inserted in the zone of the particular sealing surfaces always being adequate to ensure a reliable seal of the individual connections of the blowing lance during its operation. In this way the invention provides a cheaply producible changing device which is very safe in operation and enables the lance to be simply interchanged.

When the blowing lance is inserted into the receptable of the coupling head a chamber, more particularly an annular chamber, is formed in the zone of the connection for the coolant supply and/or the connection for the coolant discharge respectively. In a changing device constructed in this way the time required for aligning the blowing lance of the coupling head is reduced to a minimum, since there is no longer any need to position the inlet/outlet of the cooling jacket precisely opposite the corresponding connection of the coupling head.

One cheap construction of the invention which is advantageous both as regards the space required for the coupling head and the production of the blowing lance is characterised in that both the inlet and also the outlet of the cooling jacket emerge at a peripheral surface of the blowing lance.

To prevent the blowing lance from accidentally dropping out of the coupling head, the blowing lance should be releasably lockable to the coupling head. This can be achieved in a simple manner by the feature that the coupling head can be locked to the blowing lance by means of at least one hook pivotably attached to the said head, and during the insertion of the blowing lance into the receptacle of the coupling head, the hook moves automatically into its locking position. If at the same time the chamber associated with the connection for the coolant supply at least in portions encloses the free end face of the end of the blowing lance associated with the receptacle, the force exerted by the coolant on the lance in the direction of its tip results in the lance being retained clearance-free in the hook.

Conversely, however, it may also be advantageous if moulded on the blowing lance is a shoulder which extends into the chamber associated with the connection for the coolant supply and on which, when pressure is applied, the coolant exerts a force directed into the receptacle of the coupling head. In that case the pressure exerted by the coolant ensures that the blowing lance is retained in the receptacle.

Lastly, advantageously the tubular insert and the blowing tube of the blowing lance are hermetically interconnected via at least one annular seal, which is disposed between the tubular insert and the blowing tube.

BRIEF DESCRIPTION OF THE DRAWINGS

An embodiment of the invention will now be explained in greater detail with reference to the drawings, which show.

DETAILED DESCRIPTION OF THE PREFERRED EMBODIMENT

Figure 1:
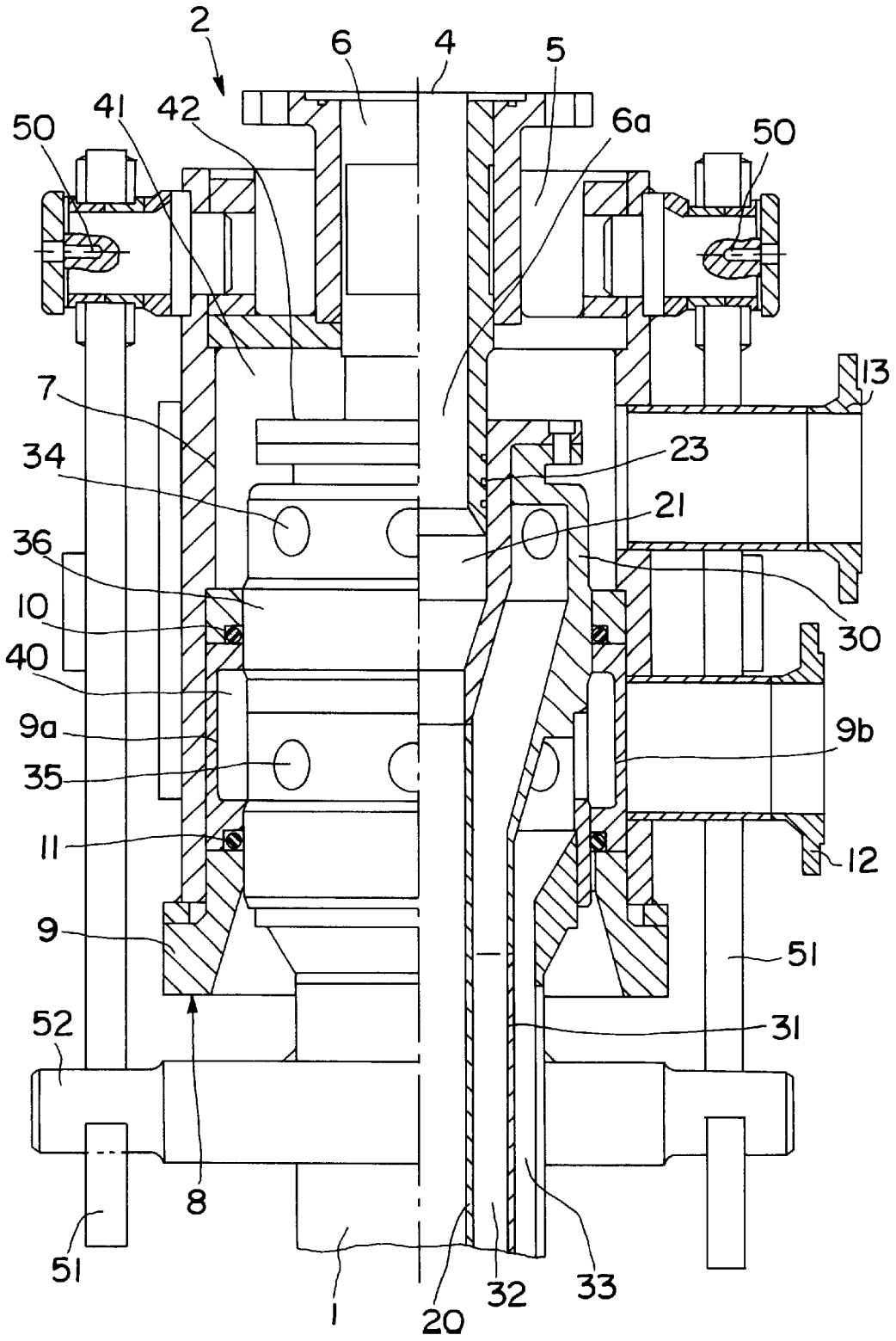
FIG. 1 is a partially opened-up frontal view of a portion of a changing device for a blowing lance.
Figure 2:
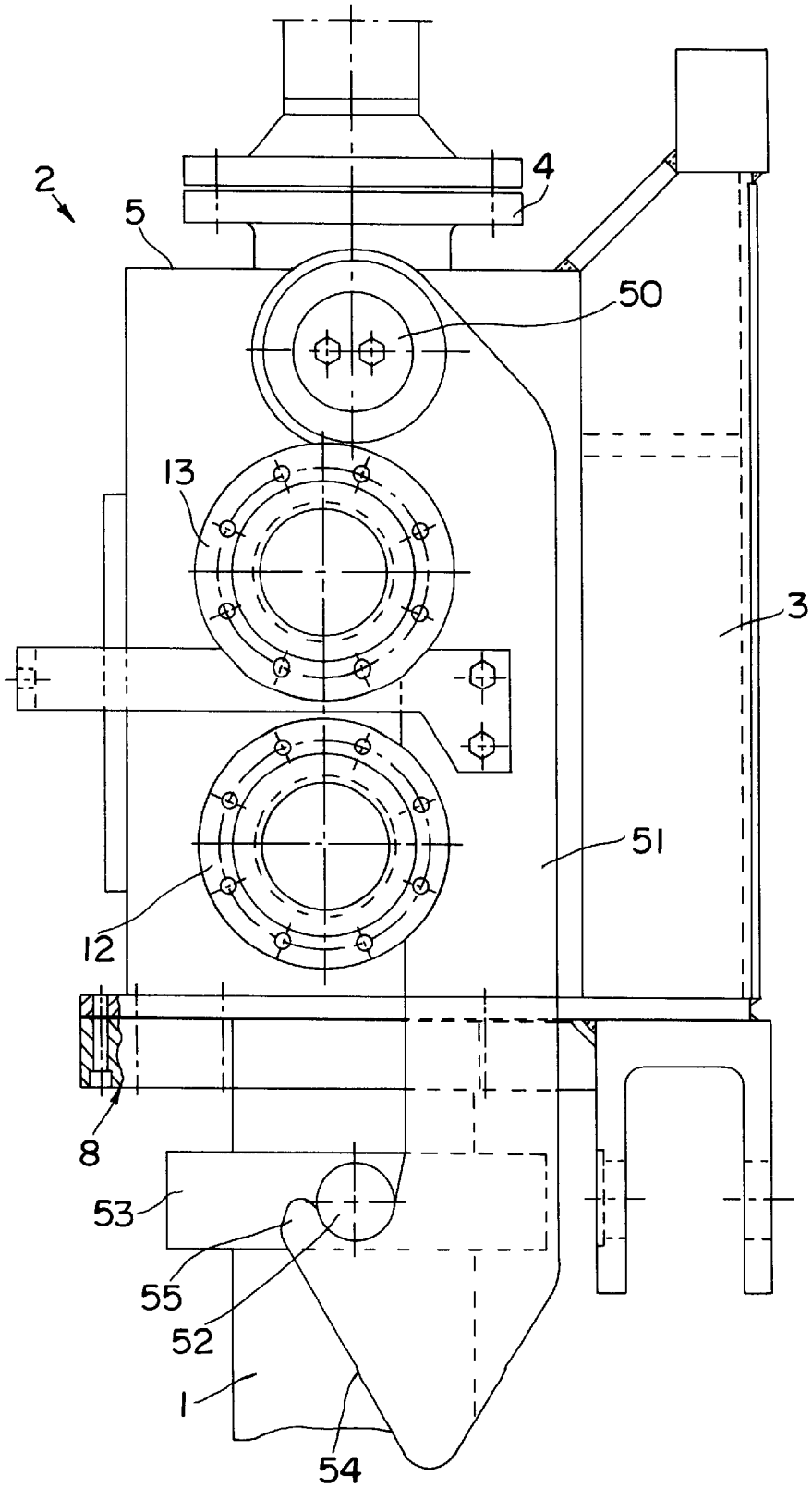
FIG. 2 is a lateral view of a portion of the changing device shown in FIG. 1.

A changing device for a blowing lance 1, as illustrated in the drawings, has a coupling head 2 which is attached to a frame (not shown) and is vertically, laterally and angularly adjustable via a guide 3. The coupling head 2 has a first connection 4 for a blowing fluid, more particularly oxygen, which is disposed on the top side 5 of the coupling head 2. Fitted into the connection 4 is a tubular insert 6 which extends by its end 6*a* associated with the inside of the coupling head 2 into a receptacle 7.

The receptacle 7 of the coupling head is opened in the direction of the underside 8 of the coupling 2. Inserted into the receptacle 7 from the underside 8 is an annular insert 9 whose lower portion widens funnel-fashion in the direction of the underside 8. Formed in the central portion of the annular insert 9 is a groove 9*a* which has a window-like opening 9*b*. Above and below the annular groove 9*a*, annular seals 10, 11 are inserted in grooves provided for this purpose.

The opening 9*b* of the annular insert 9 is associated with a second closure to which a coolant discharge line (not shown) can be connected. A third connection 13 is disposed above the second connection 12 and also discharges into the receptacle 7. A coolant supply line (also not shown) can be connection to the connection 13.

The blowing lance 1 has an internally disposed blowing tube 20 whose end portion 21, associated with the receptacle 7 of the coupling head 2, is widened and has a wall thickness greater than the rest of the length of the blowing tube. By its end portion 21 the blowing tube 20 is slipped on to the end portion 6*a* of the tube insert 6, while three annular seals 23, disposed one after the other in the axial direction of the tube portion 6, ensure that the interengaging portions of the tube insert 6 and the blowing tube 20 are sealed off from the surroundings.

The blowing tube 20 is inserted in a cooling jacket 30 of the blowing lance 1 and releasably connected thereto. The cooling jacket 30 has a partition 31 which extends coaxially with the blowing tube 20 at a distance therefrom and via which a first chamber 32 and a second chamber 33 are divided off inside the cooling jacket 30. Connected to the first chamber 32 of the cooling jacket are inlet openings 34 formed in the upper end of the blowing lance 1 associated with the receptacle 7. In contrast, the second chamber 33 emerges in outlet openings 35 which, offset in relation to the tip (not shown) of the blowing lance 1, are formed in a cooling jacket 30 below a first sealing surface 36 formed between the inlet openings 34 and the outlet openings 35. The first and second chambers 32, 33 of the cooling jacket are interconnected in the zone of the tip (not shown) of the blowing lance, so that the coolant, which flows into the first chamber 32 through the inlet openings 34, is guided along the blowing tube 20 to the tip of the blowing lance 1 and from there is washed through the chamber 33 back to the outlet openings 35.

When the blowing lance 1 is inserted into the receptacle 7, the seal 10 of the annular insert 9 bears against the first sealing surface 36 of the blowing lance 1 and seals an annular chamber 40 formed by annular groove 9*a* off from a second chamber 41 which is formed in the upper zone of the receptacle 7 and is connected to the connection 13 for the coolant supply. The second chamber 41 of the receptacle 7 encloses end face 42 of the blowing lance 1, so that the pressure of the coolant present in the chamber 41 exerts on the blowing lance 1 a force in the direction of its tip (not shown).

The blowing lance 1 is prevented from accidentally dropping out of the coupling head 2 by hooks 51 pivotably attached to the side of the coupling head 2 via pins 50. The hooks 51 engage via their hook-shaped ends 51*a* around the ends of pin-like projections 52 which are formed on retaining ring 53 rigidly connected to the blowing lance 1. At their lower end the hooks 51 have an inclined surface 54. During the insertion of the blowing lance 1 into the recess 7, the projections 52 slide along the inclined surfaces 54, so that the hook 51 is pivoted out of the conveying path 52 until the tip 55 has been passed. Then the hook 51 drops back into its starting position. The pressure exerted on the chamber 41 by the coolant then forces the blowing lance 1 into the receptacle for the hooks 51, the lance being retained clearance-free therein.

To interchange the blowing lance, when the coolant supply has been cut off from the chamber 41, the blowing lance 1 is inserted into the receptacle 7, until the hooks 51 can be pivoted free. When the hooks 51 have been pivoted away, the blowing lance can be pulled unimpeded out of the receptacle 7 and replaced by a fresh blowing lance 1.

What is claimed is:

1. A blowing lance changing device, comprising:

a blowing lance;

a coupling head including a receptacle into which an end of the blowing lance can be introduced, the receptacle including connections for coolant supply, coolant discharge and blowing fluid supply;

the blowing lance including a blowing tube and a cooling jacket through which coolant can flow and which encloses the blowing tube, the cooling jacket including an inlet and outlet disposed at the end of the blowing lance associated with the receptacle of the coupling head;

the blowing lance being releasably coupleable to the coupling head, at least the inlet or the outlet of the cooling jacket emerging at a particular peripheral surface location of the blowing lance, an associated one of the connections for coolant supply and coolant discharge corresponding to the inlet or the outlet, respectively, being disposed on a lateral surface on the receptacle corresponding to the particular peripheral surface location;

the receptacle including a tubular attachment for connection to the blowing fluid supply and with which the blowing tube is connected interengaging and hermetically when the blowing lance is introduced into the receptacle of the coupling head; and structure defining at least one chamber between the receptacle and the blowing lance when the end of the blowing lance is introduced into the receptacle of the coupling head, said at least one chamber being formed in a zone corresponding respectively to at least one of the connections of the receptacle for the coolant supply and the coolant discharge.

2. A blowing lance changing device according to claim 1, wherein said chamber is an annular chamber.

3. A blowing lance changing device according to claim 1, wherein the inlet and the outlet of the cooling jacket both emerge at a peripheral surface of the blowing lance.

4. A blowing lance changing device according to claim 1, further comprising at least one hook pivotably attached to said head for locking the coupling head to the blowing lance, the hook being automatically moved into a locking position during the insertion of the blowing lance into the receptacle of the coupling head.

5. A blowing lance changing device according to claim 1, wherein a particular one of said at least one chamber corresponding to the connection for the coolant supply at least in portions encloses a free end face of the end of the blowing lance associated with the receptacle.

6. A blowing lance changing device according to claim 1, wherein said blowing lance includes a shoulder which extends into a particular one of said at least one chamber corresponding to the connection for the coolant supply and on which, when pressure is applied, the coolant exerts a force directed into the receptacle of the coupling head.

7. A blowing lance changing device according to claim 6, wherein the shoulder is molded on the blowing lance.

8. A blowing lance changing device according to claim 1, wherein the tubular insert and the blowing tube of the blowing lance are hermetically interconnected via at least one annular seal.

* * * * *